United States Patent [19]

Huber

[11] Patent Number: 4,689,596

[45] Date of Patent: Aug. 25, 1987

[54] CURRENT-LIMITING FUSES

[75] Inventor: William J. Huber, Waukesha, Wis.

[73] Assignee: Combined Technologies, Inc., Brookfield, Wis.

[21] Appl. No.: 895,041

[22] Filed: Aug. 8, 1986

[51] Int. Cl.[4] ..... H01H 85/04

[52] U.S. Cl. ..... 337/159; 337/162

[58] Field of Search ..... 337/158, 159, 160, 161, 337/162

[56] References Cited

U.S. PATENT DOCUMENTS 3,840,836 10/1974 Link ..... 337/161

4,146,862 3/1979 Mikulecky ..... 337/158

*Primary Examiner*—Harold Broome

*Attorney, Agent, or Firm*—Ronald E. Barry

[57] ABSTRACT

A low fault current interrupting fuse assembly for a full range current limiting fuse of the type having a high fault current interrupting fuse element connected in series with the low fault current interrupting fuse assembly, said assembly including a first fuse element having a high melt temperature characteristic and a second fuse element having a low melt temperature characteristic, the first and second fuse elements being connected in parallel and having different diameters to provide current interruption at different time-current characteristics under low fault current conditions.

12 Claims, 3 Drawing Figures

CURRENT-LIMITING FUSES

BACKGROUND OF THE INVENTION

A full-range, current-limiting fuse is one where the fuse elements can sense and clear all fault currents which range from 125% to 1000× the name plate rating. The element material commonly used in current-limiting fuses is silver or copper. It takes temperatures of 960° centigrade to 1300° centigrade to melt these metals. These element temperatures can be obtained very easily when the fault current through the fuse is greater than 6× the nameplate rating.

In order to make the elements melt when the fault current is below 6x nameplate rating, several methods are used or have been used. One of the most common methods is to put a drop of solder on the midpoint of the element's length. As the fault current flows through the element, it raises the temperature of the element to a temperature above the melt temperature of the drop of solder which is much lower than the melt temperature of the element. The solder will melt and metallurgically react with the element material to cause it to melt open. This method is hard to control and can degrade the fuse element over a long period of time, causing it to open when it shouldn't. Another problem is that the resulting time-current curve of such a fuse element has an undesirable shape in that it is hard to coordinate with the other protective devices on the electrical system. Good coordination is when the time current curve of one element will lay alongside that of another element without the two curves touching or intersecting each other.

In some designs, the main fuse element is connected in series with a secondary fuse element of different design and alloy. The main element, composed of a high melt temperature alloy, controls the high-fault current interruption part of the time current curve and the secondary element, composed of a lower melt temperature alloy, controls the lower magnitude fault-current interruption part of the curve. This combination results in a curve that provides good high fault-low fault current interruption coordination but leaves some areas unacceptable. Low-fault sensing is generally achieved through the use of a series-connected fuse element composed of a eutectic alloy.

SUMMARY OF THE INVENTION

The full range, current limiting fuse according to the present invention is provided with a low fault current interruption fuse assembly which, when combined with the high fault current interruption element provides substantially improved high fault to low fault current interruption coordination. The low fault current interruption fuse assembly includes two low fault current interruption fuse elements which are connected in parallel with each other and in series with the high fault current interruption fuse element. Each of the low fault fuse elements has a different melt characteristic whereby secondary faults can be interrupted at more precise time current levels. This assures a more positive response by each of the fuse elements to a specific range of low fault time current conditions.

IN THE DRAWINGS

DESCRIPTION OF THE INVENTION

Figure 1:
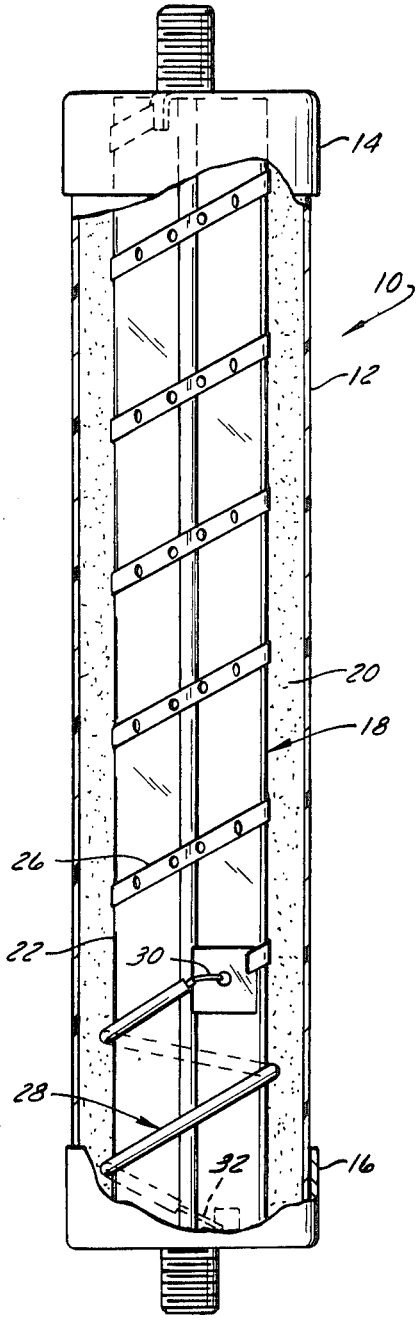
FIG. 1 is an elevation view of the current-limiting fuse partly broken away to show the high-fault current interruption sensing fuse element and the low-fault current interruption sensing assembly.
Figure 2:
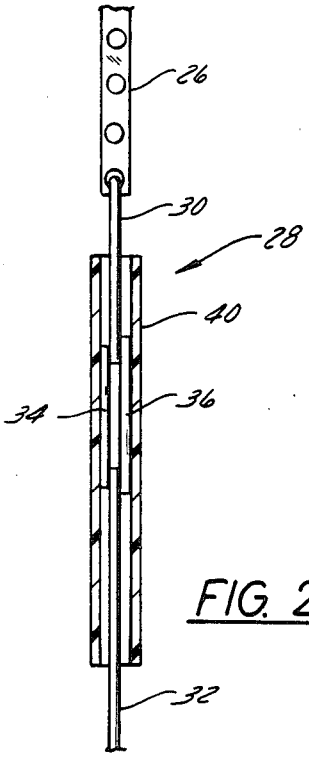
FIG. 2 is a section view of the low-fault current interruption sensing assembly shown in section.
Figure 3:
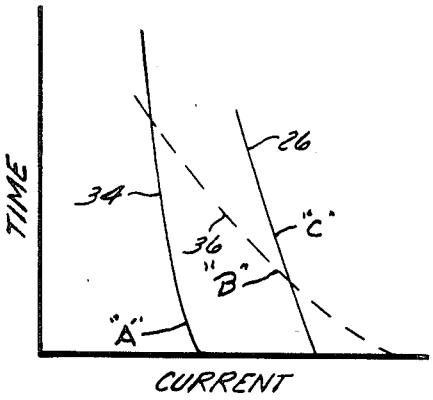
FIG. 3 is a time-current characteristic curve showing the time current curves for the three elements which make up the current limiting fuse.

The current-limiting fuse 10 according to the present invention generally includes a casing 12 having electrically conductive caps 14 and 16 at each end. A fuse device 18 is embedded in a granular dielectric material 20 within the casing 12 and is electrically connected to the caps 14 and 16. The fuse device 18 includes a dielectric spider 22 having a main or high fault current interruption fuse element 26 and a secondary low-fault current interruption fuse assembly 28 connected in series. The high-fault current interruption fuse element 26 is spirally wrapped around the dielectric spider 22 and electrically connected to the cap 14. The low-fault current interruption fuse assembly 28 is spirally wrapped around the spider 22 and is connected at one end to the element 26 and at the other end to the cap 16. As is generally understood in the art, the high fault current clearing or interruption characteristic is provided by means of the fuse element 26 and the low fault current clearing or interruption characteristic is provided by means of the current interruption fuse assembly 28.

In accordance with the present invention, the low-fault current interruption assembly 28 includes two silver fuse elements 30 and 32 which are connected in series by means of two parallel connected fuse elements 34 and 36 having different melt characteristics. The fuse element 30 is connected to the main fuse element 26. The fuse element 32 is connected to the cap 16. The current interruption assembly 28 is housed inside of a high temperature member 40 in the form of a tube made from good high voltage dielectric material such as silicon rubber. The arc-interrupting ability of the fuse elements 34 and 36 when confined within the member 40 is enhanced due to the buildup of heat and pressure within the tubular member 40.

In this regard, the first element 34 is made of a material the same as fuse elements 30 and 32 but having a smaller diameter, such material being either silver or copper. The second element 36 is made of a low-melting eutectic alloy material such as tin or nickel having a larger diameter than element 34. The two elements 34 and 36 under normal operating conditions providing parallel electrical paths across the gap between the fuse elements 30 and 32. The current passing through elements 34 and 36 will be proportional to the resistances of each element whereby element 34 will respond to fault currents within the time limits of band "A," element 36 will respond to fault currents within the time limits of band "B" and element 26 will respond to fault currents in band "C." As the current increases under low fault conditions either element 34 or 36 will eventually melt, depending on the time-current characteristic of each element. As soon as one or the other of the elements 34 or 36 melts, all of the current will then pass through the other element, which will then melt open immediately to clear and interrupt current flow. Because of the proportional relation of the fault current passing through the two parallel elements 34 and 36, a more accurate response to low fault current is provided by the low fault current sensing assembly 28.

In this regard, the fuse element 34 should have a diameter smaller than the fuse elements 30 and 32 and a melt temperature of approximately 1000° Centigrade. The fuse element 36 should have a diameter approximately 10 times the diameter of fuse element 34, and a melt temperature of approximately 350° Centigrade. With this arrangement, element 34 will respond to low current long time faults in Band "A" and element 36 to low current-short time faults in Band "B." It should be noted, however, that the current in high resistance element 34 will be much lower than the current in low resistance element 36. The current sensing assembly 28 being much more sensitive to low current-long time faults in band "B" than a single eutectic alloy element.

It should be understood that the diameters of elements 34 and 36 will vary depending on the alloy used to make the element. The diameter ratio should be chosen to provide a melt temperature characteristic of approximately 3 to 1.

The embodiments of the invention in which an exclusive property or privilege is claimed, are defined as follows:

1. A full range current limiting fuse including a housing having a conductive cap at each end, a dielectric support positioned in the housing between the conductive caps and a fuse mounted on said dielectric support and being electrically connected to said caps, said housing being filled with a granular dielectric material, said fuse including a high fault current interrupting fuse element responsive to high fault currents and having one end connected to one of said caps and a low fault current interrupting fuse assembly connected at one end in series with the high fault current interrupting fuse element and at the other end to the other cap, said low fault current interrupting fuse assembly including a first fuse element and a second fuse element connected in parallel, one of said first and second fuse elements having a melt temperature characteristic lower than the other, whereby said fuse assembly will melt open on interruption of one or the other of said first and second fuse elements.

2. The fuse according to claim 1 wherein said first fuse element has a high temperature interruption characteristic and said second fuse element has a low temperature interruption characteristic.

3. The fuse according to claim 1 wherein said first and second elements are housed within a high temperature, high dielectric, tubular member which aids in extinguishing the arc.

4. The fuse according to claim 1 wherein the diameter of the first fuse element is smaller than that of the second fuse element.

5. The fuse according to claims 3 or 4 wherein the first element has a melt temperature approximately three times that of the second element.

6. The fuse according to claims 1, 2, 3 or 4 wherein on melting of one of the first and second fuse elements all of the current will flow through the other of said first and second elements to melt the other element and interrupt current flow.

7. In a full range current limiting fuse of the type having a high fault current interrupting fuse element responsive to high fault currents, the improvement comprising a low fault current interrupting fuse assembly connected in series with said high fault current fuse element, said assembly including a first fuse element having a predetermined melt temperature characteristic, and a second fuse element having a predetermined melt temperature characteristic lower than the melt temperature characteristic of said first fuse element, said first and second fuse elements being connected in parallel with each other and in series with the high fault current interrupting fuse element whereby said fuse assembly will melt open on interruption of one or the other of said first and second fuse elements.

8. The fuse according to claim 7 wherein said first fuse element has a melt temperature characteristic approximately three times the melt temperature characteristic of the second fuse element.

9. The fuse according to claim 7 wherein said first and second fuse elements are housed within a high temperature, dielectric member which aids in extinguishing the arc produced on interruption of the first and second elements.

10. The fuse according to claims 7, 8 or 9 wherein the diameter of the first fuse element is smaller than the diameter of the second fuse element.

11. The fuse according to claims 7 or 8 wherein said first fuse element has a melt temperature characteristic approximately three times the melt temperature characteristic of said second fuse element.

12. The fuse according to claims 7, 8 or 9 wherein on melting of one of said first and second fuse elements all of the current will flow through the other of said first and second fuse elements to melt the other element and interrupt current flow.

* * * * *